US011574761B2

(12) United States Patent
Kim et al.

(10) Patent No.: US 11,574,761 B2
(45) Date of Patent: Feb. 7, 2023

(54) COIL ELECTRONIC COMPONENT

(71) Applicant: SAMSUNG ELECTRO-MECHANICS CO., LTD., Suwon-si (KR)

(72) Inventors: Jae Hun Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 807 days.

(21) Appl. No.: 16/525,729

(22) Filed: Jul. 30, 2019

(65) Prior Publication Data

US 2020/0286661 A1 Sep. 10, 2020

(30) Foreign Application Priority Data

Mar. 6, 2019 (KR) ..... 10-2019-0025971

(51) Int. Cl.
*H01F 17/00* (2006.01)
*H01F 27/28* (2006.01)
(Continued)

(52) U.S. Cl.
CPC ..... *H01F 17/0013* (2013.01); *H01F 17/04* (2013.01); *H01F 27/2847* (2013.01);
(Continued)

(58) Field of Classification Search
CPC ..... H01F 17/0013; H01F 17/04; H01F 27/2847; H01F 27/32; H01F 41/06; H01F 41/10
See application file for complete search history.

(56) References Cited

U.S. PATENT DOCUMENTS

2015/0102891 A1* 4/2015 Yoon ..... H01F 27/2804 336/200
2017/0345556 A1* 11/2017 Kim ..... H01F 17/0013
(Continued)

FOREIGN PATENT DOCUMENTS

KR 10-2015-0114924 A 10/2015
KR 10-2017-0085895 A 7/2017
KR 20170085895 A * 7/2017

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component includes a body having first to fourth surfaces, an insulating substrate disposed in the body, coil portions disposed on opposing surfaces of the insulating substrate, respectively, a first lead-out portion connected to one of the coil portions and exposed from the first and third surfaces, a second lead-out portion connected to another of the coil portions and exposed from the second and third surfaces, and first and second external electrodes covering the first and second lead-out portions, respectively. The insulating substrate includes a support portion supporting the coil portions, a first end portion extending from the support portion and including end surfaces respectively exposed from the first and third surfaces and spaced apart from each other, and a second end portion extending from the support portion and including end surfaces exposed from the second and third surfaces and spaced apart from each other.

20 Claims, 6 Drawing Sheets

(51) Int. Cl.

| | |
|---|---|
| ***H01F 27/32*** | (2006.01) |
| ***H01F 41/06*** | (2016.01) |
| ***H01F 41/10*** | (2006.01) |
| ***H01F 17/04*** | (2006.01) |

(52) U.S. Cl.
CPC ..... *H01F 27/32* (2013.01); *H01F 41/06* (2013.01); *H01F 41/10* (2013.01)

(56) References Cited

U.S. PATENT DOCUMENTS

| | | | | |
|---|---|---|---|---|
| 2018/0286561 | A1* | 10/2018 | Shimoichi | H01F 27/28 |
| 2020/0265986 | A1* | 8/2020 | Mizukami | H01F 27/32 |
| 2020/0335254 | A1* | 10/2020 | Park | H01L 23/645 |

* cited by examiner

COIL ELECTRONIC COMPONENT

CROSS-REFERENCE TO RELATED APPLICATION(S)

This application claims benefit of priority to Korean Patent Application No. 10-2019-0025971 filed on Mar. 6, 2019 in the Korean Intellectual Property Office, the disclosure of which is incorporated herein by reference in its entirety.

TECHNICAL FIELD

The present disclosure relates to a coil electronic component.

BACKGROUND

An inductor, one type of coil component, is a passive electronic component used in electronic devices along with a resistor and a capacitor.

Among coil components, a thin film coil component may be manufactured by manufacturing a coil substrate by forming a coil on an insulating substrate through a plating method, manufacturing a body by layering magnetic composite sheets including a magnetic power and resin mixed therein on the coil substrate, and forming external electrodes on an external portion of the body.

As electronic devices have been designed to have high performance and reduced sizes, an increased number of coil components have been used in electronic devices and sizes of coil components have been reduced. Accordingly, thicknesses of a thin film coil component and a coil substrate have been reduced.

However, as a thickness of a coil substrate decreases, it may be difficult to accurately control a coil substrate because of warpage of a coil substrate, and the like. As an example, a position of a coil substrate may be deformed by pressure and heat generated during a process of layering magnetic composite sheets.

SUMMARY

An aspect of the present disclosure is to provide a coil component which may significantly reduce deformation of a substrate.

Another aspect of the present disclosure is to provide a coil component which may have a reduced weight and size.

According to an aspect of the present disclosure, a coil electronic component is provided, the coil electronic component including a body having a first surface and a second surface opposing each other, and a third surface and a fourth surface connecting the first surface and the second surface and opposing each other, an insulating substrate disposed in the body, first and second coil portions disposed on opposing surfaces of the insulating substrate, respectively, a first lead-out portion connected to one end of the first coil portion and exposed from the first surface and the third surface of the body, a second lead-out portion connected to one end of the second coil portion and exposed from the second surface and the third surface of the body, and first and second external electrodes covering the first and second lead-out portions, respectively. The insulating substrate comprises a support portion supporting the first and second coil portions, a first end portion extending from the support portion and having at least a portion embedded in the first lead-out portion, and including one end surface exposed from the first surface of the body and the other end surface exposed to the third surface of the body and spaced apart from the one end surface, and a second end portion extending from the support portion and having at least a portion embedded in the second lead-out portion, and including one end surface exposed from the second surface of the body and the other end surface exposed to the third surface and spaced apart from the one end surface of the second end portion, and the other end surface of the first end portion and the other end surface of the second end portion are spaced apart from each other.

The body may have a 1608 size or less.

The coil portion may be disposed in parallel to the first surface and the second surface of the body.

The coil portion may be disposed perpendicularly to the third surface or the fourth surface of the body within an angle of 80 to 100°.

The first and second external electrodes covering the first and second lead-out portions, respectively, may extend to the first surface, the second surface, and the third surface of the body, and may not be disposed on the fourth surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
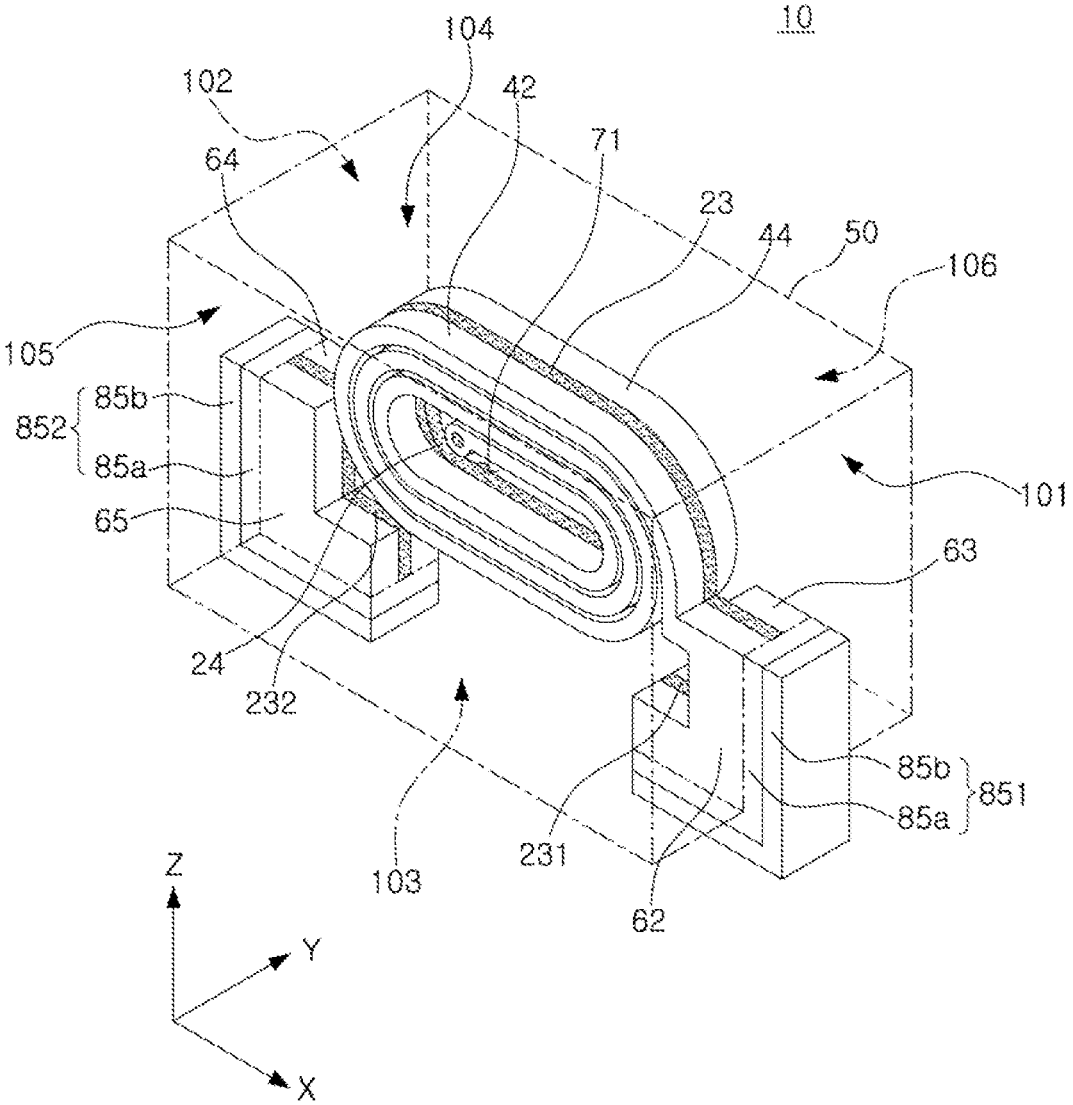
FIG. 1 is a perspective diagram illustrating a coil portion of a coil electronic component according to an example embodiment of the present disclosure.

Hereinafter, embodiments of the present disclosure will be described as follows with reference to the attached drawings.

The terms used in the following description are provided to explain a specific exemplary embodiment and are not intended to be limiting. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the terms "disposed on,"

"positioned on," "mounted on," and the like, may indicate that an element may be disposed on or below another element, and do not necessarily indicate that an element is only disposed in an upper portion with reference to a gravitational direction.

It will be understood that when an element is "coupled with/to" or "connected with" another element, the element may be directly coupled with/to another element, and there may be an intervening element between the element and another element.

Sizes and thicknesses of elements illustrated in the drawings are merely examples to help understanding of technical matters of the present disclosure.

In the drawings, an X direction is a first direction or a length direction, a Y direction is a second direction or a width direction, a Z direction is a third direction or a thickness direction.

In the drawings, same elements will be indicated by same reference numerals. Also, redundant descriptions and detailed descriptions of known functions and elements that may unnecessarily make the gist of the present invention obscure will not be provided.

In electronic devices, various types of electronic components may be used, and various types of coil components may be used between the electronic components to remove noise, and other purposes.

In an electronic device, a coil component may be used as a power inductor, an HF inductor, a general bead, a GHz bead, a common mode filter, and the like.

In the description below, an example embodiment in which a coil electronic component 10 is implemented as a thin film inductor used in a power line of a power supply circuit will be described. The coil component in example embodiments may also be implemented as a chip bead, a chip filter, and the like, other than a thin film inductor.

First Example Embodiment

Figure 2:
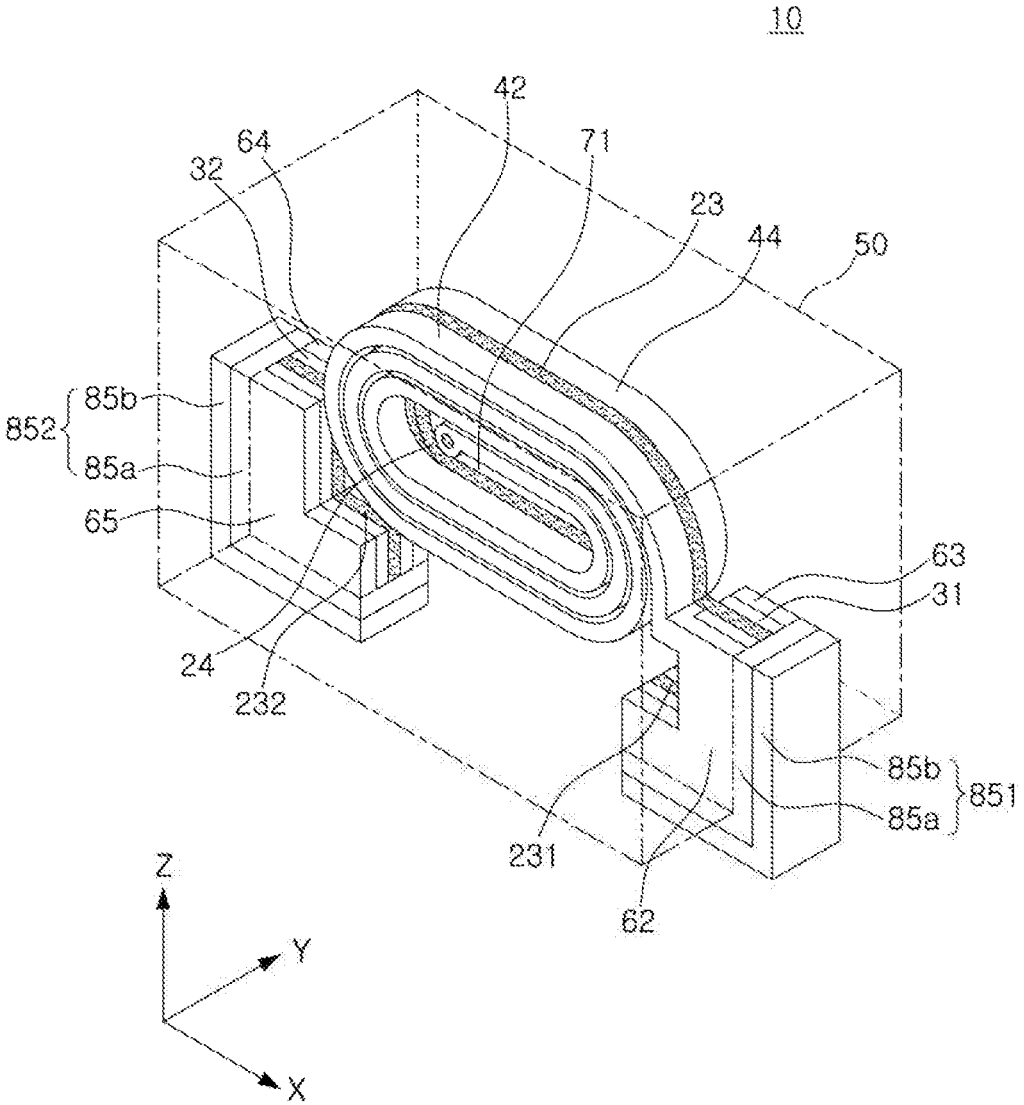
FIG. 2 is a perspective diagram illustrating a coil portion of a coil electronic component according to an example embodiment of the present disclosure.
Figure 3:
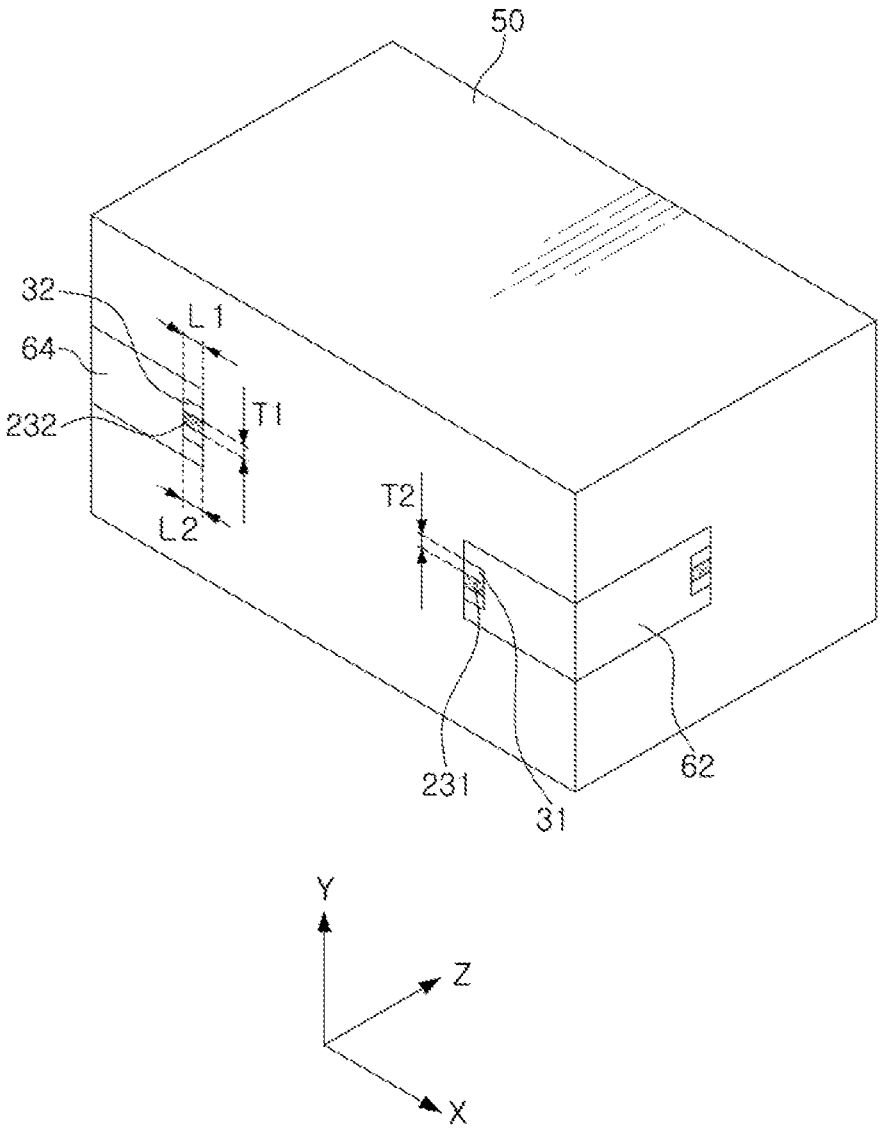
FIG. 3 is a perspective diagram illustrating a body of a coil electronic component illustrated in FIG. 2 viewed from a third surface of the body according to an example embodiment of the present disclosure.

FIG. 1 is a perspective diagram illustrating a coil portion of a coil electronic component according to an example embodiment. FIG. 2 is a perspective diagram illustrating a coil portion of a coil electronic component according to an example embodiment. FIG. 3 is a perspective diagram illustrating a body of a coil electronic component illustrated in FIG. 2 viewed from a third surface of the body according to an example embodiment.

Referring to FIGS. 1 to 3, a coil electronic component 10 in an example embodiment may include a body 50, an insulating substrate 23, coil portions 42 and 44, lead-out portions 62 and 64, and external electrodes 851 and 852, and may further include reinforcing layers 31 and 32.

The body 50 may form an exterior of the coil electronic component 10, and may include the insulating substrate 23 disposed therein.

The body 50 may have a hexahedral shape.

The body 50 may include a first surface 101 and a second surface 102 opposing each other in a length direction (X), a third surface 103 and a fourth surface 104 opposing each other in a thickness direction (Z), and a fifth surface 105 and a sixth surface 106 opposing each other in a width direction (Y). The third surface 103 and the fourth surface 104 of the body 50 opposing each other may connect the first surface 101 and the second surface 102 of the body 50 opposing each other.

The body 50 may be configured such that the coil electronic component 10 including the external electrodes 851 and 852 disposed therein may have a length of 0.2±0.1 mm, a width of 0.25±0.1 mm, and a thickness of 0.4 mm, but an example embodiment thereof is not limited thereto.

The body 50 may include a magnetic material and an insulating resin. For example, the body 50 may be formed by layering one or more magnetic material sheets including an insulating resin and a magnetic material dispersed in the insulating resin. The body 50 may also have a structure different from the structure in which a magnetic material is disposed in an insulating resin. For example, the body 50 may be formed of a magnetic material such as ferrite.

The magnetic material may be ferrite power or magnetic metal power.

The ferrite power may be one or more of spinel ferrite such as Mg—Zn based ferrite, Mn—Zn based ferrite, Mn—Mg based ferrite, Cu—Zn based ferrite, Mg—Mn—Sr based ferrite, Ni—Zn based ferrite, and the like, hexagonal ferrite such as Ba—Zn based ferrite, Ba—Mg based ferrite, Ba—Ni based ferrite, Ba—Co based ferrite, Ba—Ni—Co based ferrite, and the like, garnet ferrite such as Y based ferrite, and Li based ferrite, for example.

The magnetic metal power may include at least one of iron (Fe), silicon (Si), chromium (Cr), cobalt (Co), molybdenum (Mo), aluminum (Al), niobium (Nb), copper (Cu), and nickel (Ni) or alloys thereof. For example, the magnetic metal power may be at least one or more of pure iron powder, Fe—Si based alloy power, Fe—Si—Al based alloy power, Fe—Ni based alloy power, Fe—Ni—Mo based alloy power, Fe—Ni—Mo—Cu based alloy power, Fe—Co based alloy power, Fe—Ni—Co based alloy power, Fe—Cr based alloy power, Fe—Cr—Si based alloy power, Fe—Si—Cu—Nb based alloy power, Fe—Ni—Cr based alloy power, and Fe—Cr—Al based alloy power.

The magnetic metal power may be amorphous or crystalline. For example, the magnetic metal power may be Fe—Si—B—Cr based amorphous alloy power, but an example embodiment thereof is not limited thereto.

An average diameter of each of the ferrite power and the magnetic metal power may be 0.1 μm to 30 μm, but an example embodiment thereof is not limited thereto.

The body 50 may include two or more different types of magnetic materials disposed in an insulating resin. The notion that different types of magnetic materials may be included indicates that the magnetic materials may be distinguished from each other by one of an average diameter, a composition, crystallinity, and a shape.

The insulating resin may include one of epoxy, polyimide, a liquid crystal polymer, and the like, or combinations thereof, but an example embodiment thereof is not limited thereto.

The insulating substrate 23 may be disposed in the body 50, and the coil portions 42 and 44 may be disposed in both surfaces of the insulating substrate 23, respectively. The insulating substrate 23 may include a support portion 24 supporting the coil portions 42 and 44, and end portions 231 and 232 supporting the lead-out portions 62 and 64. A thickness T1 of the insulating substrate 23 may be 10 μm or greater and 60 μm or less. When a thickness of the insulating substrate 23 is less than 10 μm, electrical shorts may occur between the coil portions 42 and 44, and when a thickness of the insulating substrate 23 is greater than 60 μm, a thickness of the coil component may increase such that it may be difficult to reduce a size of the coil component. According to the example embodiment, when a thickness of the insulating substrate 23 is 30 μm, Ls (pH) may decrease by 7.2%, and Isat (A) may increase by 8.9%, as compared to the example in which the thickness is 60 μm, and when a thickness of the insulating substrate 23 is 20 μm, Ls (pH)

may increase by 2.5%, and Isat (A) may increase by 2.2%, as compared to the example in which the thickness is 30 μm.

The insulating substrate 23 may be formed of a thermosetting insulating resin such as an epoxy resin, a thermoplastic insulating resin such as a polyimide resin, or an insulating material including a photosensitive insulating resin, or may be formed of an insulating material in which a reinforcement such as glass fiber or an inorganic filler is impregnated in the above-mentioned insulating materials. For example, the insulating substrate 23 may be formed of an insulating material such as prepreg, Ajinomoto build-up film (ABF), FR-4, bismaleimide triazine (BT), a photoimageable dielectric (PID), or the like, but an example of the material may not be limited thereto.

As the inorganic filler, at least one or more elements selected from among a group consisting of silica ($SiO_2$), aluminum oxide ($Al_2O_3$), silicon carbide (SiC), barium sulfate ($BaSO_4$), talc, mud, mica power, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the insulating substrate 23 is formed of an insulating material including reinforcement, the insulating substrate 23 may provide improved stiffness. When the insulating substrate 23 is formed of an insulating material which does not include glass fiber, overall thicknesses of the coil portions 42 and 44 may be easily reduced. When the insulating substrate 23 is formed of an insulating material including a photosensitive insulating resin, the number of processes for forming the coil portions 42 and 44 may be reduced such that production costs may decrease and a fine via may be formed.

The support portion 24 may be disposed between the coil portions 42 and 44 of the insulating substrate 23 and may support the coil portions 42 and 44.

The first end portion 231 may extend from the support portion 24, may be disposed between the first lead-out portion 62 and a first dummy lead-out portion 63, and may support the first lead-out portion 62 and the first dummy lead-out portion 63. The second end portion 232 may extend from the support portion 24, may be disposed between the second lead-out portion 64 and a second dummy lead-out portion 65, and may support the second lead-out portion 64 and the second dummy lead-out portion 65.

For example, the first end portion 231 may extend from the support portion 24, and at least a portion of the first end portion 231 may be embedded in the first lead-out portion 62, and the first end portion 231 may include one end surface exposed to the first surface 101 of the body 50 and the other end surface exposed to the third surface 103 and spaced apart from the one end surface. The second end portion 232 may extend from the support portion 24, and at least a portion of the second end portion 232 may be embedded in the second lead-out portion 64, and the second lead-out portion 64 may include one end surface exposed to the second surface 102 of the body 50 and the other end surface spaced apart from the one end surface.

The coil portions 42 and 44 may be disposed on both surfaces of the insulating substrate 23 opposing each other, and may implement properties of the coil electronic component. For example, when the coil electronic component 10 is used as a power inductor, the coil portions 42 and 44 may maintain an output voltage by storing electric fields as magnetic fields, thereby stabilizing power of an electronic device.

The coil portions 42 and 44 in an example embodiment may be disposed perpendicularly to the third surface 103 or the fourth surface 104 of the body 50.

The notion that the coil portions 42 and 44 may be disposed perpendicularly to the third surface 103 or the fourth surface 104 may indicate that the surfaces of the coil portions 42 and 44 adjacent to the insulating substrate 23 may be disposed perpendicularly or almost perpendicularly to the third surface 103 or the fourth surface 104 of the body 50. For example, the coil portions 42 and 44 may be disposed perpendicularly to the third surface 103 or the fourth surface 104 of the body 50 within an angle of 80 to 100°.

The coil portions 42 and 44 may be disposed in parallel to the fifth surface 105 and the sixth surface 106 of the body 50. Thus, surfaces of the coil portions 42 and 44 in contact with the insulating substrate 23 may be in parallel to the fifth surface 105 and the sixth surface 106 of the body 50.

As the body 50 may have a 1608 size or 1006 or less, a thickness of the body 50 may be greater than a width, and a cross-sectional surface of the body 50 taken in an XZ direction may be greater than a cross-sectional surface of the body 50 taken in an XY direction. Accordingly, as the coil portions 42 and 44 may be disposed perpendicularly to the third surface 103 or the fourth surface 104 of the body 50, an area in which the coil portions 42 and 44 may be disposed may increase.

For example, when a length of the body 50 is 1.6±0.2 mm and a width is 0.8±0.05 mm, a thickness of the body 50 may satisfy a range of 1.0±0.05 mm (1608 size). When a length of the body 50 is 0.2±0.1 and a width is 0.25±0.1 mm, a thickness of the body 50 may satisfy a maximum of 0.4 mm or less (1006 size). As the thickness is greater than the width, the coil portions 42 and 44 may secure a greater area when the coil portions 42 and 44 are disposed perpendicularly to the third surface 103 or the fourth surface 104 of the body 50, as compared to the example in which the coil portions 42 and 44 are disposed horizontally to the third surface 103 or the fourth surface 104 of the body 50. The greater the area of the coil portions 42 and 44, the more the inductance (L) and quality factor (Q) may improve.

Each of the first coil portion 42 and the second coil portion 44 may have a planar spiral form forming at least one turn with reference to a core portion 71 as a shaft. As an example, the first coil portion 42 may form at least one turn with reference to the core portion 71 as a shaft on one surface of the insulating substrate 23.

The coil portions 42 and 44 may include a spiral-shaped coil pattern, and the coil portions 42 and 44 disposed on both surfaces of the insulating substrate 23 opposing each other may be electrically connected to each other through a via electrode (not illustrated) formed in the insulating substrate 23.

The coil portions 42 and 44 and the via electrode (not illustrated) may include a metal having high conductivity. For example, the coil portions 42 and 44 and the via electrode (not illustrated) may be formed of silver (Ag), palladium (Pd), aluminum (Al), nickel (Ni), titanium (Ti), gold (Au), copper (Cu), platinum (Pt), or alloys thereof, or other elements.

The lead-out portions 62 and 64 may be exposed to the first surface 101 and the second surface 102 of the body 50, respectively. For example, the first lead-out portion 62 and the first dummy lead-out portion 63 may be exposed to the first surface 101 of the body 50, and the second lead-out portion 64 and the second dummy lead-out portion 65 may be exposed to the second surface 102 of the body 50.

Referring to FIGS. 1 and 2, one end of the first coil portion 42 formed on one surface of the insulating substrate 23 may extend and may form the first lead-out portion 62, and the first lead-out portion 62 may be exposed to the first surface 101 and the third surface 103 of the body 50. Also, one end of the second coil portion 44 may extend to the other surface of the insulating substrate 23, opposing the one surface, and may form the second lead-out portion 64, and the second lead-out portion 64 may be exposed to the second surface 102 and the third surface 103 of the body 50. An area in which the first and second lead-out portions 62 and 64 of the example embodiment are disposed may be narrower than a width of the body 50. The first and second lead-out portions 62 and 64 may extend from the first surface 101 and the second surface 102 of the body 50, respectively, and may be led out to the third surface 103, and the first and second lead-out portions 62 and 64 may not be disposed on the fourth surface 104, the fifth surface 105, and the sixth surface 106 of the body 50.

Referring to FIGS. 1 to 3, the external electrodes 851 and 852 and the coil portions 42 and 44 may be connected to each other through the lead-out portions 62 and 64 disposed in the body 50. In an example embodiment, however, the first lead-out portion 62 may be configured to be connected to the first dummy lead-out portion 63 in integrated form and the second lead-out portion 64 may be configured to be connected to the second dummy lead-out portion 65 in integrated form to improve cohesion force between the external electrodes 851 and 852 and the lead-out portions 62 and 64, respectively. When the lead-out portions 62 and 64 and the dummy lead-out portions 63 and 65 are disposed separately, as electrical connectivity of the end portions 231 and 232 may be different from that of the lead-out portions 62 and 64, a notch structure may be formed in an area between the first lead-out portion 62 and the first dummy lead-out portion 63 and between the second lead-out portion 64 and the second dummy lead-out portion 65, an area in which the end portions 231 and 232 are disposed. As illustrated in FIGS. 1 and 2, as each of the lead-out portions have an "L" shaped form, an internal portion of each of the lead-out portions 62 and 64 may also be processed to have an "L" shaped form. After the processing, the end portions 231 and 232 may be embedded in a staircase form in accordance with the form of the remaining lead-out portions 62 and 64 disposed in the body 50. Accordingly, both surfaces of the lead-out portions 62 and 64 may be exposed to the first to third surfaces 101, 102, and 103 of the body in the lead-out portions 62 and 64. The first end portion 231 may extend from the support portion 24, and at least a portion of the first end portion 231 may be embedded in the first lead-out portion 62, and the first end portion 231 may include one end surface exposed to the first surface 101 of the body 50, and the other end surface exposed to the third surface 103 and spaced apart from the one end surface. The second end portion 232 may extend from the support portion 24, and at least a portion of the second end portion 232 may be embedded in the second lead-out portion 64, and the second end portion 232 may include one end surface exposed to the second surface 102 of the body 50 and the other end surface exposed to the third surface 103 and spaced apart from the one end surface. The other end surface of the first end portion 231 may be spaced apart from the other end surface of the second end portion 232. While the embedded end portions 231 and 232 are removed, the insulating substrate 23, particularly the end portions 231 and 232 may be deformed. Thus, the reinforcing layers 31 and 32 supporting the end portions 231 and 232 may be disposed preferentially.

The lead-out portions 62 and 64 may include a conductive metal such as copper (Cu), and may be formed while the coil portions are plated. As the lead-out portions 62 and 64 formed consecutively on the first to third surfaces of the body are formed in the body 50, a contact area between the lead-out portions and the external electrodes may increase as compared to a general lower electrode structure, and accordingly, a size of a coil electronic component may be reduced and high capacity may be implemented.

The reinforcing layers 31 and 32 may be disposed on at least one surface of the end portions 231 and 232. Referring to FIGS. 1 to 6, the reinforcing layers 31 and 32 may extend from one end surfaces of the end portions 231 and 232 to the other surfaces. For example, at least a portion of the first reinforcing layer 31 may be embedded in the first lead-out portion 62, and the first reinforcing layer 31 may extend from one end surface of the first end portion 231 exposed to the first surface 101 of the body to the other end surface of the first end portion 231 exposed to the third surface 103 and spaced apart from the one end surface. At least a portion of the second reinforcing layer 32 may be embedded in the second lead-out portion 64, and the second reinforcing layer 32 may extend from one end surface of the second end portion 232 exposed to the second surface 102 of the body to the other end surface of the second end portion 232 exposed to the third surface 103 and spaced apart from the one end surface. In an example embodiment, a thickness T2 of each of the reinforcing layers 31 and 32 may be 1 μm or greater and 50 μm or less. When a thickness of the insulating substrate 23 is 60 μm, a thickness of each of the reinforcing layers 31 and 32 may be adjusted to between 1 μm and 2 μm, and a minimum thickness of each of the reinforcing layers 31 and 32 corresponding to the insulting substrate 23 may be 1 μm or greater. As described above, as a thickness of the insulting substrate 23 decreases, a thickness of each of the reinforcing layers 31 and 32 may relatively increase. When a thickness of the insulting substrate 23 is 25 μm, a thickness of each of the reinforcing layers 31 and 32 may be adjusted to be 18 μm or greater. When a thickness of the insulting substrate 23 is 15 μm, a thickness of each of the reinforcing layers 31 and 32 may be adjusted to be 35 μm or greater. When a thickness of each of the reinforcing layers 31 and 32 exceeds 50 μm, an overall thickness of the coil component may increase such that it may be difficult to reduce a size of the coil component.

Referring to FIGS. 1 to 3, a length L1 of each of both surfaces of the end portions 231 and 232 may correspond to a length L2 of each of both surfaces of the reinforcing layers 31 and 32. In an example embodiment, exposed positions of the reinforcing layers 31 and 32 on the surfaces of the body 50 in relation to the insulating substrate 23 may vary depending on a position of a plating resist 33 (shown in FIG. 4C). In an example embodiment, as the plating resist 33 is formed in an area in contact with the reinforcing layers 31 and 32, the length L1 of each of both surfaces of the end portions 231 and 232, exposed to the first surface 101, the second surface 102, and the third surface 103 of the body 50, may be the same as the length L2 of each of both surfaces of the reinforcing layers 31 and 32, exposed to the first surface 101, the second surface 102, and the third surface 103 of the body 50, as illustrated in FIG. 3.

The dummy lead-out portions 63 and 65 may be disposed on one surface and the other surface of the insulating substrate 23 to correspond to lead-out portions 62 and 64. In an example embodiment, the first dummy lead-out portion 63 disposed on a surface of the insulating substrate 23 opposing the first lead-out portion 62 and the second dummy lead-out portion 65 disposed on a surface of the insulating substrate 23 opposing the second lead-out portion 64 may be further included. In the example embodiment, to improve cohesion force between the external electrodes 851 and 852 and the lead-out portions 62 and 64, the first lead-out portion 62 may be configured to be connected to the first dummy lead-out portion 63 in integrated form, and the second lead-out portion 64 may be configured to be connected to the second dummy lead-out portion 65 in integrated form.

At least one of the coil portions 42 and 44, the via electrode (not illustrated), the lead-out portions 62 and 64, and the dummy lead-out portions 63 and 65 may include at least one or more conductive layers.

As an example, when the coil portions 42 and 44, the dummy lead-out portions 63 and 65, and the via electrode (not illustrated) are formed on the other surface of the insulating substrate 23 by a plating process, the coil portions 42 and 44, the dummy lead-out portions 63 and 65, and the via electrode (not illustrated) may include a seed layer such as an electroless plating layer, and an electroplating layer. The electroplating layer may have a single layer structure, or may have a multilayer structure. The electroplating layer having a multilayer structure may be formed in a conformal film structure in which one electroplating layers covers the other electroplating layer, or may be formed in a form in which one electroplating layer is layered only on one surface of the other electroplating layer. The seed layers of the coil portions 42 and 44, the seed layers of the dummy lead-out portions 63 and 65, and the seed layer of the via electrode (not illustrated) may be integrated with one another such that a boundary may not be formed therebetween, but an example embodiment thereof is not limited thereto. The electroplating layers of the coil portions 42 and 44, the electroplating layers of the dummy lead-out portions 63 and 65, and the electroplating layer of the via electrode (not illustrated) may be integrated with one another such that a boundary may not be formed therebetween, but an example embodiment thereof is not limited thereto.

The coil portions 42 and 44, the lead-out portions 62 and 64, the dummy lead-out portions 63 and 65, and the via electrode (not illustrated) may be formed of a conducive material such as copper (Cu), aluminum (Al), silver (Ag), tin (Sn), gold (Au), nickel (Ni), lead (Pb), titanium (Ti), or alloys, but the material may not be limited thereto.

Referring to FIGS. 1 and 2, as the dummy lead-out portions 63 and 65 are layered adjacently to a magnetic sheet on which the coil portions 42 and 44, the first lead-out portion 62, and the second lead-out portion 64 are disposed, a greater number of metal combinations with the external electrodes 851 and 852 disposed on the first surface 101, the second surface 102, and the third surface 103 of the body 50 may occur. Accordingly, adhesion force between the coil portions 42 and 44 and the external electrodes 851 and 852 and adhesion force between an electronic component and a printed circuit board may improve.

The external electrodes 851 and 852 may be disposed on the first surface 101, the second surface 102, and the third surface 103 of the body 50.

In an example embodiment, the first external electrode 851 may be disposed on the first surface 101 and the third surface 103 of the body 50 to be connected to the first lead-out portion 62 exposed to the first surface 101 and the third surface 103 of the body 50, and the second external electrode 852 may be disposed on the second surface 102 and the third surface 103 of the body 50 to be connected to the second lead-out portion 64 exposed to the second surface 102 and the third surface 103 of the body 50. An area in which the external electrodes 851 and 852 are disposed may be narrower than a width of the body 50. The first external electrode 851 may cover the first lead-out portion 62, may extend from the first surface 101 of the body 50, and may be disposed on the third surface 103, and may not be disposed on the fourth surface 104, the fifth surface 105, and the sixth surface 106 of the body 50. The second external electrode 852 may cover the second lead-out portion 64, may extend from the second surface 102 of the body 50, and may be disposed on the third surface 103, and may not be disposed on the fourth surface 104, the fifth surface 105, and the sixth surface 106 of the body 50.

As the external electrodes 851 and 852 are formed on the third surface 103, the effect from the external electrodes 851 and 852 which interferes with a flow of magnetic flux may be reduced such that an inductor performance such as inductance (L), quality factor (Q), and the like, may improve.

Each of the external electrodes 851 and 852 may have a single layer structure or may have a multilayer structure. Each of the external electrodes 851 and 852 may include a first layer 85*a* covering the lead-out portions 62 and 64 and a second layer 85*b* covering the first layer 85*a*. For example, in the coil component of an example embodiment, the first layer 85*a* may include nickel (Ni), and the second layer 85*b* may include tin (Sn).

Method of Manufacturing Coil Electronic Component

FIGS. 4A to 4D are diagrams illustrating portions of processes of a method for manufacturing a coil electronic component in order according to an example embodiment.

Figure 4B:
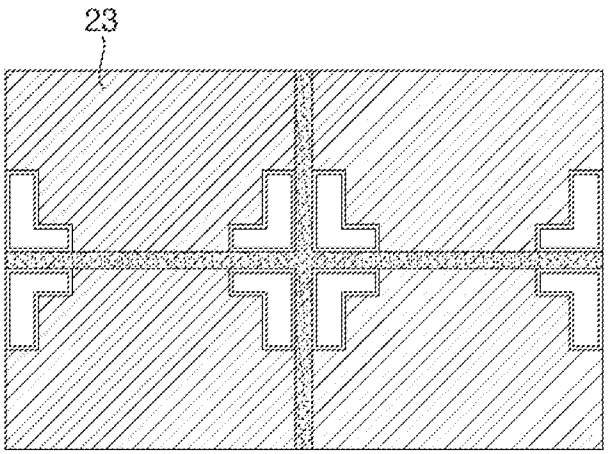
FIGS. 4A-4D are cross-sectional diagrams illustrating a method of manufacturing a coil electronic component illustrated in FIGS. 1 to 3 according to an example embodiment of the present disclosure.
Figure 4A:
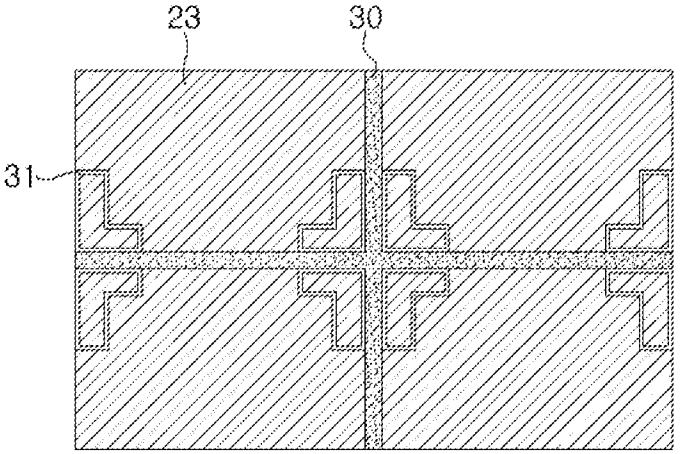

Referring to FIG. 4A, a copper foil layer 30 and reinforcing layers 31 and 32 may be formed on an insulating substrate 23.

As an example, the copper foil layer 30 and the reinforcing layer 31 may be formed by forming an etching resist having an opening on one surface of a copper clad laminate (CCL), etching a copper foil exposed to the opening, and removing the etching resist. The reinforcing layers 31 and 32 may be formed of a copper foil. The etching resist may be formed by layering dry films (DF) on the copper clad laminate and performing a photolithography process. As the etching resist covers a region corresponding to the copper foil layer 30 of a copper foil and the first reinforcing layer 31, the copper foil layer 30 and the first reinforcing layer 31 may consequently remain on the insulating substrate 23. However, an example embodiment thereof may not be limited thereto, and the copper foil layer 30 and the reinforcing layers 31 and 32 may also be formed through a selective plating process on one surface of prepreg (PPG).

The copper foil layer 30 may be a plating inlet line for an electroplating process.

The reinforcing layers 31 and 32 may be disposed on end portions 231 and 232 of the insulating substrate 23 to prevent deformation of the insulating substrate 23. The reinforcing layers 31 and 32 may form a closed loop, and a portion of the insulating substrate 23 may be surrounded by the closed loop.

Referring to FIG. 4B, a region of the insulating substrate 23 in which lead-out portions 62 and 64 are disposed may be removed.

For example, as the lead-out portion has an "L" shaped form, an internal portion of each of the lead-out portions 62 and 64 may be processed to have an "L" shaped form. During the process, the region of the insulating substrate 23 closed by the reinforcing layers 31 and 32 may be removed. When the region of the insulating substrate 23 is removed using laser, warpage of the insulating substrate 23 may occur by energy applied by laser. As the insulating substrate 23, particularly the end portions 231 and 232, may be deformed during the process of removing the embedded end portions 231 and 232, the reinforcing layers 31 and 32 supporting the end portions 231 and 232 may be disposed preferentially.

After processing, the end portions 231 and 232 may be embedded in a staircase form in accordance with a form of the lead-out portions 62 and 64 disposed in the body 50. Accordingly, both surfaces of each of the end portions 231 and 232 may be exposed to first to third surfaces 101, 102, and 103 of the body in the lead-out portions 62 and 64. Thus, the first end portion 231 may extend from a support portion 24, and at least a portion of the first end portion 231 may be embedded in the first lead-out portion 62, and the first end portion 231 may include one end surface exposed to the first surface 101 of the body 50 and the other end surface exposed to the third surface 103 and spaced apart from the one end surface. The second end portion 232 may extend from the support portion 24, and at least a portion of the second end portion 232 may be embedded in the second lead-out portion 64, and the second end portion 232 may include one end surface exposed to the second surface 102 of the body 50 and the other end surface exposed to the third surface 103 and spaced apart from the one end surface. The other end surface of the first end portion 231 may be spaced apart from the other end surface of the second end portion 232.

Figure 4D:
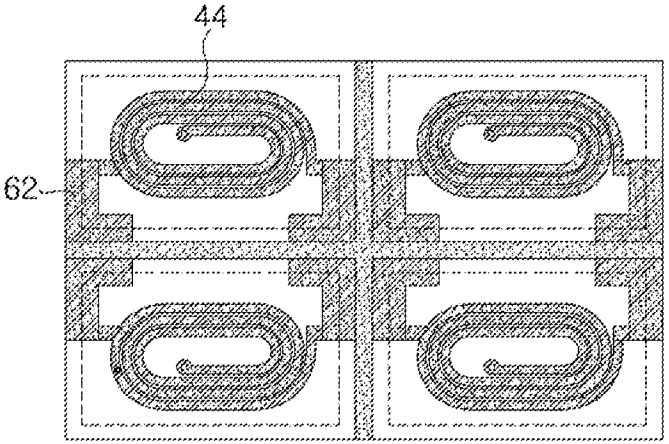
Figure 4C:
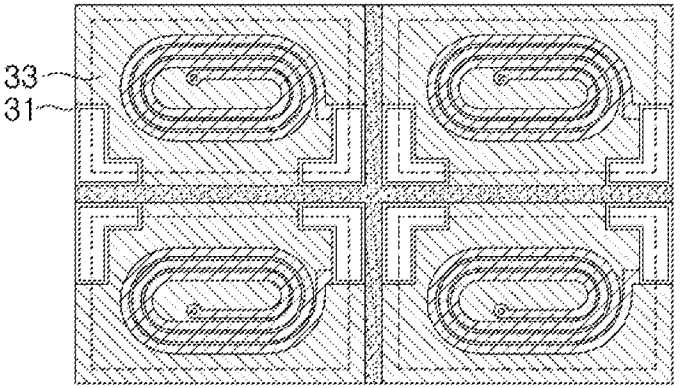

Referring to FIG. 4C, the plating resist 33 having an opening corresponding to the coil portions 42 and 44 and an opening corresponding to the lead-out portions 62 and 64 may be formed on the insulating substrate 23.

Referring to FIG. 4D, the lead-out portions 62 and 64 and the coil portions 42 and 44 may be formed on the insulating substrate 23 through an electroplating process, the plating resist 33 may be removed, and a trimming process may be performed.

Referring to FIGS. 1 to 3, a length L1 of each of both surfaces of the end portions 231 and 232 may correspond to a length L2 of each of both surfaces of the reinforcing layers 31 and 32. In an example embodiment, exposed positions of the reinforcing layers 31 and 32 on the surfaces of the body 50, relative to the insulating substrate 23, may vary depending on a position of the plating resist 33. In an example embodiment, as the plating resist 33 is formed in a region in contact with the reinforcing layers 31 and 32, the length L1 of each of both surfaces of the end portions 231 and 232, exposed to the first surface 101, the second surface 102, and the third surface 103 of the body 50, may be the same as the length L2 of each of both surfaces of the reinforcing layers 31 and 32, exposed to the first surface 101, the second surface 102, and the third surface 103 of the body 50, as illustrated in FIG. 3.

Second Example Embodiment

Figure 5:
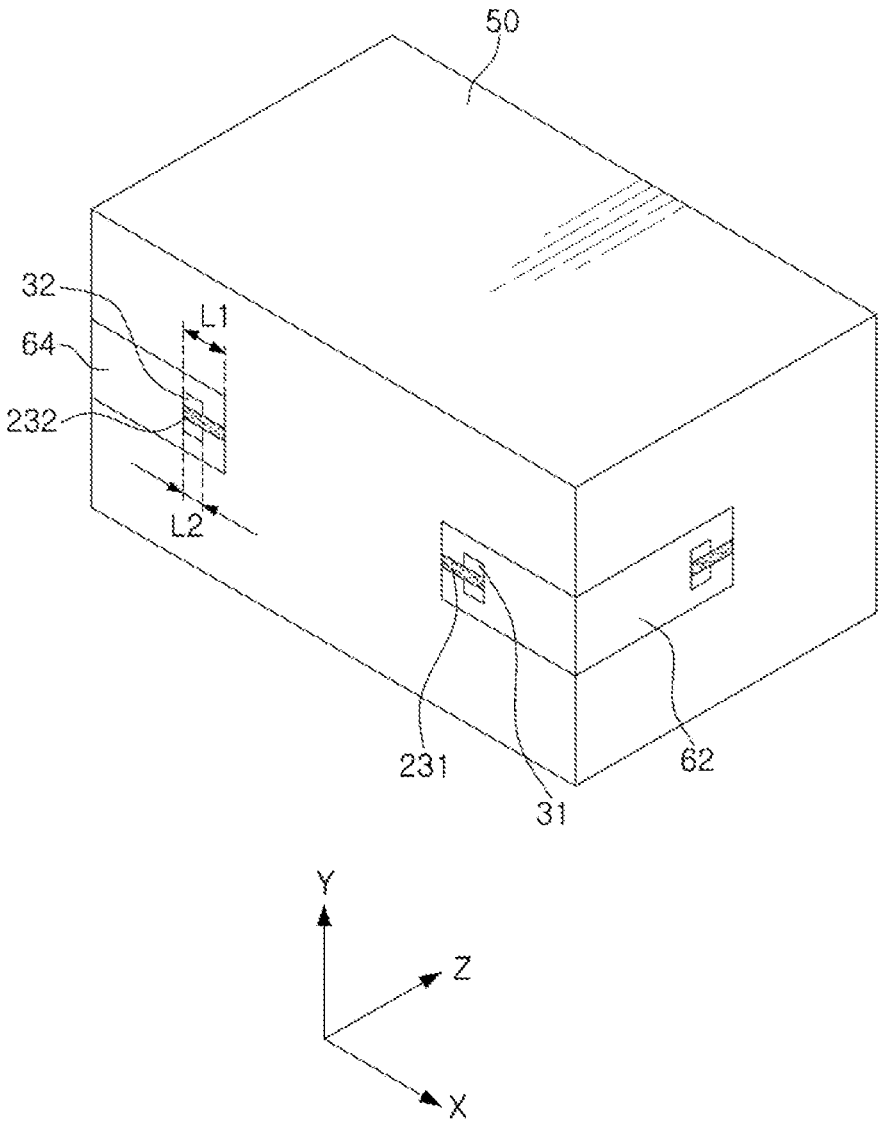
FIG. 5 is a perspective diagram illustrating a body of a coil electronic component viewed from a third surface of the body according to another example embodiment of the present disclosure.

In the example embodiment, the same descriptions of the configuration described in the aforementioned example embodiment may be applied. FIG. 5 is a perspective diagram illustrating a body of a coil electronic component viewed from a third surface of the body according to another example embodiment.

FIG. 5 is a perspective diagram illustrating a body other than a region of external electrodes 851 and 852 in the coil electronic component 10, viewed from a third surface of the body. Referring to FIGS. 1 to 4, as compared to the coil electronic component 10 in the aforementioned example embodiment, positions of the reinforcing layers 31 and 32 may be different. Thus, in the example embodiment, only the structures of the reinforcing layers 31 and 32, different from the structures of the reinforcing layers 31 and 32 described in the aforementioned example embodiment, will be described. The descriptions of the other elements will be the same as in the aforementioned example embodiments.

The reinforcing layers 31 and 32 may be disposed at least one surface of the end portions 231 and 232. Referring to FIGS. 1 to 6, the reinforcing layers 31 and 32 may extend from one end surface of the end portions 231 and 232 to the other end surface. For example, at least a portion of the first reinforcing layer 31 may be embedded in a first lead-out portion 62, and the first reinforcing layer 31 may extend from one end surface of the first end portion 231 exposed to the first surface 101 of the body to the other end surface exposed to the third surface 103 and spaced apart from the one end surface. At least a portion of the second reinforcing layer 32 may be embedded in the second end portion 232, and the second reinforcing layer 32 may extend from one end surface of the second end portion 232 exposed to the second surface 102 to the other end surface of the second end portion 232 exposed to the third surface 103 and spaced apart from the one end surface. In the example embodiment, a thickness T2 of each of the reinforcing layers 31 and 32 may be 1 μm or greater and 50 μm or less. When a thickness of the insulating substrate 23 is 60 μm, a thickness of each of the reinforcing layers 31 and 32 may be adjusted to between 1 μm and 2 μm, and a minimum thickness of each of the reinforcing layers 31 and 32 corresponding to the insulating layer 23 may be 1 μm or greater. As described above, as a thickness of the insulating layer 23 decreases, a thickness of each of the reinforcing layers 31 and 32 may relatively increase. When a thickness of the insulting substrate 23 is 25 μm, a thickness of each of the reinforcing layers 31 and 32 may be adjusted to be 18 μm or greater. When a thickness of the insulting substrate 23 is 15 μm, a thickness of each of the reinforcing layers 31 and 32 may be adjusted to be 35 μm or greater. When a thickness of each of the reinforcing layers 31 and 32 exceeds 50 μm, an overall thickness of the coil component may increase such that it may be difficult to reduce a size of the coil component.

Referring to FIG. 5, exposed positions of the reinforcing layers 31 and 32 on the surfaces of the body 50, relative to the insulating substrate 23, may vary depending on a position of a plating resist 33.

Referring to FIG. 5, as the plating resist 33 is disposed in external regions of the reinforcing layers 31 and 32, the length L1 of each of both surfaces of the end portions 231 and 232 may be longer than the length L2 of each of both surfaces of the reinforcing layers 31 and 32. Accordingly, an area of the lead-out portions 62 and 64 exposed to the third surface 103 of the body may expand by the length (L1-L2) corresponding to the region of the outer portions of the reinforcing layers in which the plating resist 33 is disposed.

Third Example Embodiment

Figure 6:
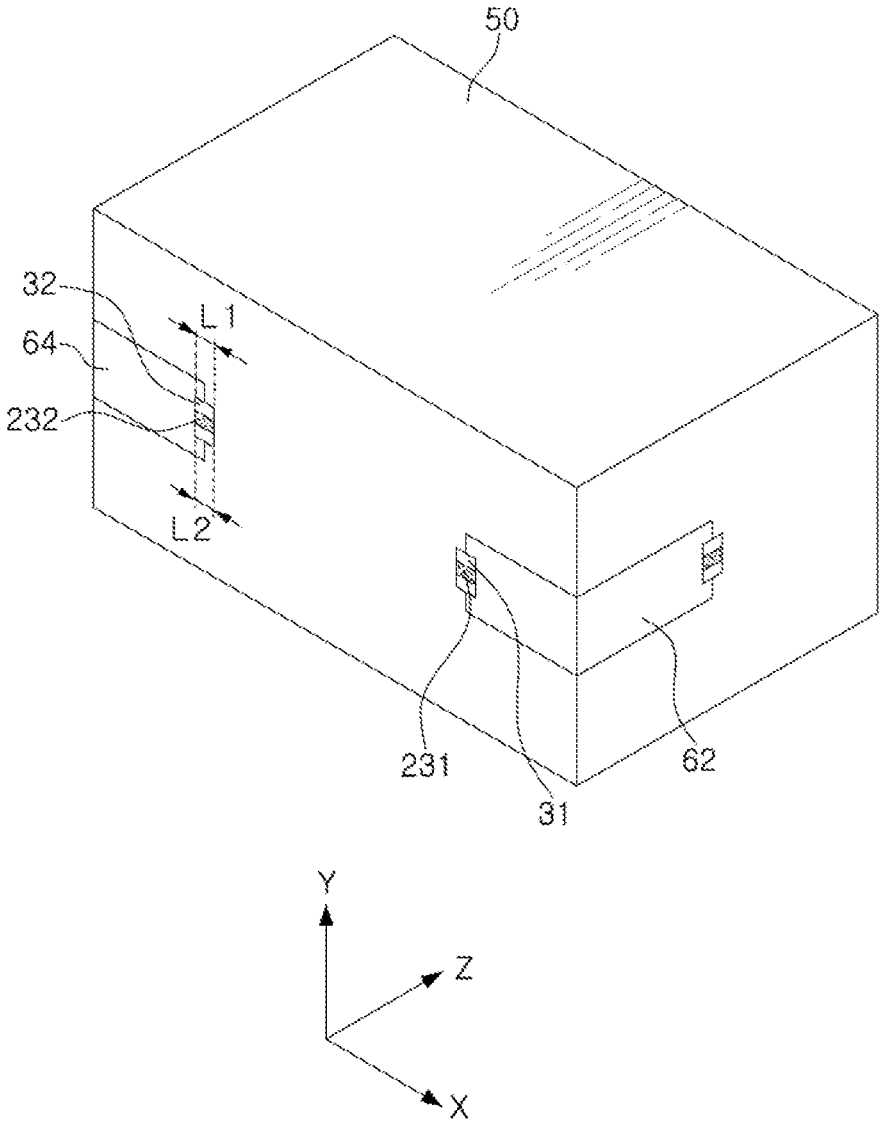
FIG. 6 is a perspective diagram illustrating a body of a coil electronic component viewed from a third surface of the body according to another example embodiment of the present disclosure.

FIG. 6 is a perspective diagram illustrating a body of a coil electronic component viewed from a third surface of the body according to another example embodiment.

FIG. 6 is a perspective diagram illustrating a body other than a region of the external electrodes 851 and 852 in a coil electronic component 10. Referring to FIGS. 1 to 4, as compared to the coil electronic component 10 described in the aforementioned example embodiment, positions of reinforcing layers 31 and 32 may be different. Thus, in the example embodiment, only the different structures of the reinforcing layers 31 and 32, different from the structures of the reinforcing layers 31 and 32 described in the aforementioned example embodiment, will be described. The descriptions of the other elements will be the same as in the aforementioned example embodiments.

The reinforcing layers 31 and 32 may be disposed at least one surface of the end portions 231 and 232. Referring to FIGS. 1 to 6, the reinforcing layers 31 and 32 may extend from one end surface of the end portions 231 and 232 to the other end surface. For example, at least a portion of the first reinforcing layer 31 may be embedded in a first lead-out portion 62, and the first reinforcing layer 31 may extend from one end surface of the first end portion 231 exposed to the first surface 101 of the body to the other end surface exposed to the third surface 103 and spaced apart from the one end surface. At least a portion of the second reinforcing layer 32 may be embedded in the second end portion 232, and the second reinforcing layer 32 may extend from one end surface of the second end portion 232 exposed to the second surface 102 to the other end surface of the second end portion 232 exposed to the third surface 103 and spaced apart from the one end surface. In the example embodiment, a thickness T2 of each of the reinforcing layers 31 and 32 may be 1 μm or greater and 50 μm or less. When a thickness of the insulating substrate 23 is 60 μm, a thickness T2 of each of the reinforcing layers 31 and 32 may be adjusted to between 1 μm and 2 μm, and a minimum thickness of each of the reinforcing layers 31 and 32 corresponding to the insulating layer 23 may be 1 μm or greater. As described above, as a thickness of the insulating layer 23 decreases, a thickness of each of the reinforcing layers 31 and 32 may relatively increase. When a thickness of the insulting substrate 23 is 25 μm, a thickness of each of the reinforcing layers 31 and 32 may be adjusted to be 18 μm or greater. When a thickness of the insulting substrate 23 is 15 μm, a thickness of each of the reinforcing layers 31 and 32 may be adjusted to be 35 μm or greater. When a thickness of each of the reinforcing layers 31 and 32 exceeds 50 μm, an overall thickness of the coil component may increase such that it may be difficult to reduce a size of the coil component.

Referring to FIG. 6, exposed positions of the reinforcing layers 31 and 32 on the surfaces of the body 50, relative to the insulating substrate 23, may vary depending on a position of a plating resist 33.

Referring to FIG. 6, the length L1 of each of both surfaces of the end portions 231 and 232 exposed to the first surface 101, the second surface 102, and the third surface 103 of the body 50 may be configured to the same as the length L2 of each of both surfaces of the reinforcing layers 31 and 32 exposed to the first surface 101, the second surface 102, and the third surface 103 of the body 50. As the plating resist 33 is disposed in internal portions of the reinforcing layers 31 and 32, the insulating substrate 23 and the reinforcing layers 31 and 32 may be disposed in a region corresponding to a boundary surface of the lead-out portions 62 and 64 exposed to the third surface 103 of the body 50.

According to the aforementioned example embodiments, quality of the coil electronic component may increase by reducing deformation of a substrate.

Also, even when a chip size is significantly reduced, by increasing an area of the coil portion in the same chip size, high capacity may be implemented.

Further, by reducing the effect of a mounting substrate and external electrodes which may interfere with a flow of magnetic flux, a performance such as inductance (L), quality factor (Q), and the like, may improve.

While the exemplary embodiments have been shown and described above, it will be apparent to those skilled in the art that modifications and variations could be made without departing from the scope of the present invention as defined by the appended claims.

What is claimed is:

1. A coil electronic component, comprising:

a body having a first surface and a second surface opposing each other, and a third surface and a fourth surface connecting the first surface and the second surface and opposing each other;

an insulating substrate disposed in the body;

first and second coil portions disposed on opposing surfaces of the insulating substrate, respectively;

a first lead-out portion connected to one end of the first coil portion and extending from the first surface and the third surface of the body;

a second lead-out portion connected to one end of the second coil portion and extending from the second surface and the third surface of the body; and first and second external electrodes covering the first and second lead-out portions, respectively, wherein the insulating substrate comprises:

a support portion supporting the first and second coil portions;

a first end portion extending from the support portion and having at least a portion embedded in the first lead-out portion, and including one end surface exposed from the first surface of the body and the other end surface exposed from the third surface of the body and spaced apart from the one end surface of the first end portion, the first end portion including a recess recessed from a corner between the first surface and the third surface toward to an interior of the body; and a second end portion extending from the support portion and having at least a portion embedded in the second lead-out portion, and including one end surface exposed from the second surface of the body and the other end surface exposed from the third surface and spaced apart from the one end surface of the second end portion, the second end portion including a recess recessed from a corner between the second surface and the third surface toward to the interior of the body.

2. The coil electronic component of claim 1, wherein the other end surface of the first end portion and the other end surface of the second end portion are spaced apart from each other.

3. The coil electronic component of claim 1, further comprising:

first and second reinforcing layers disposed on at least one surface of each of the first and second end portions.

4. The coil electronic component of claim 3, wherein the first reinforcing layer extends from the one end surface of the first end portion to the other end surface of the first end portion, and wherein the second reinforcing layer extends from the one end surface of the second end portion to the other end surface of the second end portion.

5. The coil electronic component of claim 4, wherein lengths of the both end surfaces of the first end portion correspond to lengths of both end surfaces of the first and second reinforcing layers disposed on the first end portion, and lengths of the both end surfaces of the second end portion correspond to lengths of both end surfaces of the first and second reinforcing layers disposed on the second end portion.

6. The coil electronic component of claim 4, wherein lengths of the both end surfaces of the first end portions are longer than lengths of both end surfaces of the first and second reinforcing layers disposed on the first end portion, and lengths of the both end surfaces of the second end portions are longer than lengths of both end surfaces of the first and second reinforcing layers disposed on the second end portion.

7. The coil electronic component of claim 3, wherein thicknesses of the first and second reinforcing layers are 1 μm or greater and 50 μm or less.

8. The coil electronic component of claim 1, wherein a thickness of the insulating substrate is 10 μm or greater and 60 μm or less.

9. The coil electronic component of claim 1, wherein widths of the first and second lead-out portions are less than a width of the body.

10. The coil electronic component of claim 1, wherein widths of the first and second external electrodes are less than a width of the body.

11. The coil electronic component of claim 1, wherein the first and second external electrodes comprises a first layer disposed on the first and second lead-out portions, and a second layer covering the first layer, respectively.

12. The coil electronic component of claim 10, wherein the first layer comprises nickel (Ni), and wherein the second layer comprises tin (Sn).

13. The coil electronic component of claim 1, wherein a portion of the first end portion, extending from the third surface, includes a first portion covered by a first conductive portion and a second portion covered by a second conductive portion having a thickness greater than that of the first conductive portion, a portion of the second end portion, extending from the third surface, includes a third portion covered by a third conductive portion and a fourth portion covered by a fourth conductive portion having a thickness greater than that of the third conductive portion.

14. The coil electronic component of claim 1, wherein a portion of the first end portion, extending from the first surface, includes a first portion covered by a first conductive portion and a second portion covered by a second conductive portion having a thickness greater than that of the first conductive portion, a portion of the second end portion, extending from the second surface, includes a third portion covered by a third conductive portion and a fourth portion covered by a fourth conductive portion having a thickness greater than that of the third conductive portion.

15. The coil electronic component of claim 1, wherein the first end portion includes an L-shaped structure, and the second end portion includes an L-shaped structure.

16. A coil electronic component, comprising:

a body having a first surface and a second surface opposing each other, and a third surface and a fourth surface connecting the first surface and the second surface and opposing each other;

an insulating substrate disposed in the body;

first and second coil portions disposed on opposing surfaces of the insulating substrate, respectively;

a first lead-out portion connected to one end of the first coil portion and extending from the first surface and the third surface of the body;

a second lead-out portion connected to one end of the second coil portion and extending from the second surface and the third surface of the body;

first and second reinforcing layers disposed on at least one surface of each of the first and second end portions, and spaced apart from an inner turn of the first coil portion and an inner turn of the second coil portion; and first and second external electrodes covering the first and second lead-out portions, respectively, wherein the insulating substrate comprises:

a support portion supporting the first and second coil portions;

a first end portion extending from the support portion and having at least a portion embedded in the first lead-out portion, and including one end surface exposed from the first surface of the body and the other end surface exposed from the third surface of the body and spaced apart from the one end surface of the first end portion; and a second end portion extending from the support portion and having at least a portion embedded in the second lead-out portion, and including one end surface exposed from the second surface of the body and the other end surface exposed from the third surface and spaced apart from the one end surface of the second end portion.

17. The coil electronic component of claim 16, wherein the first reinforcing layer extends from the one end surface of the first end portion to the other end surface of the first end portion, and the second reinforcing layer extends from the one end surface of the second end portion to the other end surface of the second end portion.

18. The coil electronic component of claim 17, wherein lengths of the both end surfaces of the first end portion correspond to lengths of both end surfaces of the first and second reinforcing layers disposed on the first end portion, and lengths of the both end surfaces of the second end portion correspond to lengths of both end surfaces of the first and second reinforcing layers disposed on the second end portion.

19. The coil electronic component of claim 16, wherein the other end surface of the first end portion and the other end surface of the second end portion are spaced apart from each other.

20. The coil electronic component of claim 16, wherein the first and second reinforcing layers includes an L-shaped pattern.

* * * * *